US011898102B2

(12) United States Patent
Xin et al.

(10) Patent No.: US 11,898,102 B2
(45) Date of Patent: Feb. 13, 2024

(54) METHOD FOR MAXIMIZING ETHYLENE OR PROPENE PRODUCTION

(71) Applicant: Zhejiang Comy Environment Technology Co., Ltd, Ningbo (CN)

(72) Inventors: Benen Xin, Ningbo (CN); Zongjun Ye, Ningbo (CN)

(73) Assignee: Zhejiang Comy Environment Technology Co., Ltd, Ningbo (CN)

( * ) Notice: Subject to any disclaimer, the term of this patent is extended or adjusted under 35 U.S.C. 154(b) by 0 days.

(21) Appl. No.: 17/596,103

(22) PCT Filed: Nov. 17, 2020

(86) PCT No.: PCT/CN2020/129237

§ 371 (c)(1),
(2) Date: Dec. 2, 2021

(87) PCT Pub. No.: WO2021/174910

PCT Pub. Date: Sep. 10, 2021

(65) Prior Publication Data

US 2023/0193140 A1 Jun. 22, 2023

(30) Foreign Application Priority Data

Aug. 12, 2020 (CN) ..... 202010809365.4

(51) Int. Cl.

| | |
|---|---|
| ***C10G 1/10*** | (2006.01) |
| ***C10G 9/36*** | (2006.01) |
| ***C10G 11/20*** | (2006.01) |
| ***C10G 69/04*** | (2006.01) |
| ***C10G 69/06*** | (2006.01) |
| ***C10G 1/00*** | (2006.01) |
| ***C10G 67/04*** | (2006.01) |
| ***C10G 69/12*** | (2006.01) |

(52) U.S. Cl.

CPC ..... *C10G 1/10* (2013.01); *C10G 1/002* (2013.01); *C10G 9/36* (2013.01); *C10G 11/20* (2013.01); *C10G 67/0454* (2013.01); *C10G 69/04* (2013.01); *C10G 69/06* (2013.01); *C10G 69/126* (2013.01); *C10G 2300/1003* (2013.01); *C10G 2300/107* (2013.01); *C10G 2300/4006* (2013.01); *C10G 2300/4012* (2013.01); *C10G 2300/4018* (2013.01); *C10G 2300/4025* (2013.01); *C10G 2300/4081* (2013.01); *C10G 2300/807* (2013.01); *C10G 2400/08* (2013.01); *C10G 2400/20* (2013.01); *C10G 2400/30* (2013.01)

(58) Field of Classification Search

CPC . C10G 1/002; C10G 1/10; C10G 9/36; C10G 11/20; C10G 67/0454; C10G 69/04; C10G 69/06; C10G 2300/1003

See application file for complete search history.

(56) References Cited

U.S. PATENT DOCUMENTS

| | | | | |
|---|---|---|---|---|
| 8,658,023 | B2 * | 2/2014 | Coleman | C10G 69/00 208/78 |
| 10,526,552 | B1 | 1/2020 | Choi et al. | |
| 2016/0264874 | A1 | 9/2016 | Narayanaswamy et al. | |
| 2019/0367428 | A1 * | 12/2019 | Ramamurthy | C07C 4/06 |
| 2020/0115644 | A1 | 4/2020 | Choi et al. | |
| 2021/0163833 | A1 * | 6/2021 | Harale | B01D 53/0423 |

FOREIGN PATENT DOCUMENTS

| | | | |
|---|---|---|---|
| CN | 103270141 | A | 8/2013 |
| CN | 109563413 | A | 4/2019 |
| CN | 111825514 | A | 10/2020 |

OTHER PUBLICATIONS

ISR of PCT/CN2020/129237.

* cited by examiner

*Primary Examiner* — Randy Boyer
(74) *Attorney, Agent, or Firm* — Zhigang Ma

(57) ABSTRACT

Disclosed is a method for maximizing ethylene or propene production, the main steps thereof being: taking crude oil and distillate thereof, pre-processing urban mixed-waste plastics as raw material, then entering same into a catalytic cracking reactor, removing via a two-stage pre-wash tower and related separation, then cooling the reacted high-temperature oil and gas and removing impurities to obtain light and heavy distillate oils; performing a hydrogenation reaction operation on the heavy distillate oil; performing light distillate oil separation, performing a recombination operation on its olefins, its alkanes entering a steam cracking apparatus to produce rich ethylene, and its aromatic components being separated as by-products; the product of the described hydrogenation and recombination reaction and the steam-cracked distillate oil is recycled to the catalytic cracking reactor. In the production method of the present invention, the yield of ethylene and propene together is 45-75 m % of the raw material, and the yield of aromatics is 15-30 m % of the raw material; in particular, when using urban mixed-waste plastics as raw material, the ethylene or propene thus produced are used to produce new plastics by way of a conventional polymerization process, achieving the chemical recycling of waste plastics.

8 Claims, 5 Drawing Sheets

METHOD FOR MAXIMIZING ETHYLENE OR PROPENE PRODUCTION

TECHNICAL FIELD

The present disclosure relates to the technical field of production of ethylene or propene, and in particular, relates to a METHOD FOR MAXIMIZING ETHYLENE OR PROPENE PRODUCTION. In addition, the present disclosure also relates to the technical field of solid waste treatment and utilization, and in particular, relates to a method for chemically recycling waste plastic from life and industrial wastes.

BACKGROUND

The conventional raw materials for production of ethylene by steam cracking are always limited to naphtha. Since the naphtha resource is limited and part of naphtha is required to enter a reforming device to produce arenes, the production capacity of the ethylene is always restricted by the limitation of the raw materials. Therefore, how to expand the raw materials for steam cracking in large quantities is one of the key issues in improving production capacity of the ethylene.

Plastic is widely used in various industries, for example: in textile industry, household appliance industry, building industry, automobile industry, agriculture, and the like. Waste plastic is increasing with increasing consumption of plastic products. At present, the waste plastics in China mainly include plastic films, plastic wires, woven products, foamed plastics, plastic packing cases and containers, daily plastic products, plastic bags, agricultural mulching films, and the like.

A prominent problem in plastic recycling, as compared to metal recycling, is the difficulty in automated sorting by machine. Thus, the process involves a lot of manpower. The recycling and utilization rate of the plastic is generally low, which causes a huge waste of resources, and the garbage generated by using a large number of plastic products causes serious environmental pollution in the case of being treated by methods such as burying, burning, and the like.

In view of the above, it is desirable to provide a method for maximizing production of ethylene or propene from waste plastic or other oils.

SUMMARY

The present disclosure provides a method for maximizing production of ethylene or propene, comprising the following steps:

S1, pretreating a raw material, mixing the pretreated raw material with superheated steam in a mixer, and feeding the well-mixed raw material and superheated steam into a catalytic cracking reactor, wherein the raw material is converted into waste residue and high-temperature oil and gas in the presence of a catalyst;

obtaining light distillate oil, heavy distillate oil, a gaseous product, and the like by cooling and purifying the high-temperature oil and gas using a two-stage prewashing column; wherein the two-stage prewashing column includes a section for preheating and a section for desuperheating;

S2, hydrogenating the heavy distillate oil in step S1, reforming alkene components in the light distillate oil and separating benzene-toluene-xylene (BTX) components in the light distillate oil as one of products; and feeding alkane components in the light distillate oil to a steam cracking device;

S3, recycling the products formed by hydrogenating and the products formed by reforming, and the steam-cracked distillate oil obtained in step S2 to the catalytic cracking reactor in step S1, and once more carrying out a selective catalytic cracking reaction in the catalytic cracking reactor, wherein a mass ratio of a total amount of the recycled products to an amount of a fresh raw material is 10-60:100; and S4, feeding the gaseous product in step S1 to the steam cracking device, and collectively separating methane, ethane, ethylene, propane, propene, and the like, wherein ethylene and propene are used as the products; and returning the ethane, the propane, other alkanes, and the like to the steam cracking device;

wherein by the above steps, the raw material is finally converted into the products comprising methane, the ethane, ethylene, propene, BTX, and the like, wherein the total yield of ethylene and propene is 45-75 m % of the raw materials, the yield of the arene BTX is 15-30 m % of the raw materials, and the majority of the remainder is methane.

The catalytic cracking reaction is characterized in that the products of the reaction are selectable. When the reaction is intended for maximizing production of the ethylene, the propane and butane are firstly obtained as the main products of the catalytic cracking reaction, wherein the total yield of the propane and butane is about over 60 m % of the raw materials. Then, the propane and butane are fed into the steam cracking device to produce the ethylene. That is, production of the ethylene is maximized. When the reaction is intended for maximizing production of the propene, the main product of the catalytic cracking reaction is propene, and the yield of the propene is about over 40 m % of the raw materials. In this case, the yield of the propane and butane by steam cracking is about 10-20 m % of the raw materials. Apparently, the catalytic cracking process is mainly responsible for converting plastic oil (or referred to as a liquefied substance of waste plastic), a bottom fraction of atmospheric distillation and the like into the propene and BTX, or the propane and BTX. And the steam cracking process is mainly responsible for converting topped oil, and alkanes including propane, butane and the like produced by catalytic cracking into the ethylene. In addition, cracked gasoline and the like liquid-phase products produced by the steam cracking are returned into the catalytic cracking reactor for redistillation.

With reference to the specification, claims, and drawings hereinafter, a person skilled in the art could further understand these and other features, advantages, and objectives disclosed in the present disclosure.

In the figures, the references are as follows: 1—melting vessel, 2—two-stage prewashing column, 3—mixer,

4—catalytic cracking reactor, 5—regenerator, 6—atmospheric distillation column, 7—butane deasphalting column, 8-1 #hydrogenation reactor, 9-2 #hydrogenation reactor, 10—high-pressure separator, 11—low-pressure separator, 12—alkaline tower, 13—water scrubber, 14—hydrogenated distillation column, 15—compressor, 16—steam cracking device, 17—$C_2$ removing column, 18—demethanizer column, 19—ethylene column, 20—propene column, 21—oligomerization reactor; 22—reformed product distillation column, 101—shredding device, 102—pipeline iron remover, 103-1 #transfer pump, 201—three-phase separator, 202-2 #transfer pump, 203-1 #circulation pump, 204-2 #circulation pump, 205-1 #cooler, 206-3 #circulation pump, 207-2 #cooler, 170-1 #two-phase separator, 171-1 #reflux pump, 172-1 #overhead cooler, 180-2 #two-phase separator, 181-2 #reflux pump, 182-2 #overhead cooler, 183-3 #transfer pump, 190-3 #two-phase separator, 191-3 #reflux pump, 192-3 #overhead cooler, 210-4 #two-phase separator, 211-4 #reflux pump, 212-4 #overhead cooler, 501—buffer tank, 502—catalyst dosing tank, 901-1 #preheater, 1101-4 #transfer pump, 1301-2 #preheater, 1401-4 #circulation pump, 2001—section for preheating, 2002—section for desuperheating, and 2101-5 #circulation pump.

DETAILED DESCRIPTION

In this text, the terms such as "first," "second," "third," and the like, and the signs such as "1 #," "2 #," "3 #," and the like are used in this description for distinguishing one raw material, product, device, or operation from another raw material, product, device, or operation, instead of implying any actual relationship and sequence of the raw material, product, device, or operation. The terms "comprise," "include," and derivatives thereof used herein are intended to indicate any non-exclusive meaning, such that a device including the steps and processors not only includes some listed elements, but also includes unlisted other elements.

As used herein in this text, the term "and"/"or" in reference to a list of two or more items covers all of the following interpretations of the term: any of the items in the list, all of the items in the list or any combination of the items in the list. For example, in the case that the raw material or the product is described as comprising a component A and/or a component B, the raw material or the product may include a single one of the component A and the component B, or include a combination of the component A and the component B.

Figure 1:
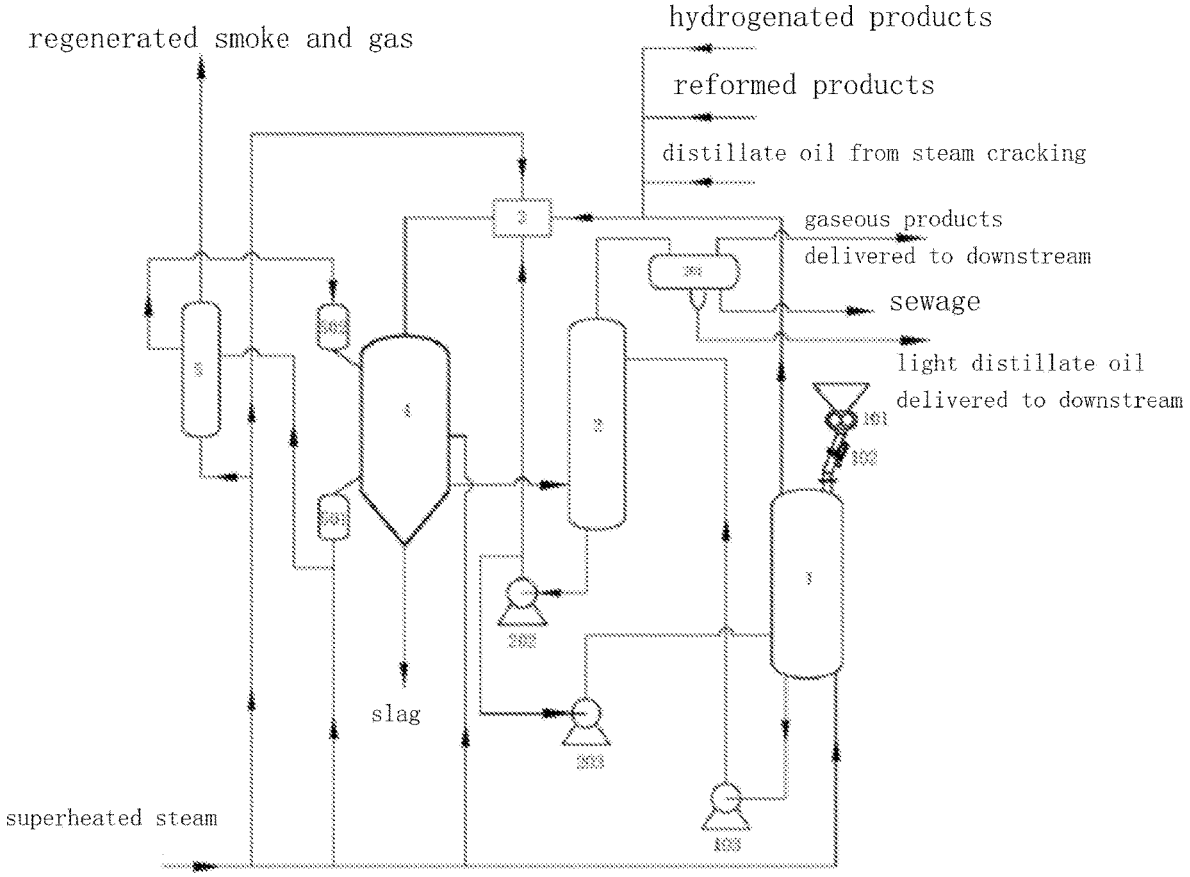
FIG. 1 illustrates a process flowchart of preheating, hot-melting, catalytic cracking, and the like treatment steps for mixed waste plastic from city as a raw material.

Now referring to FIG. 1, in at least one embodiment of the method for maximizing production of ethylene or propene, mixed waste plastic from city is used as a raw material in the maximized production of ethylene or propene. The main components of the mixed waste plastic from city include polyethylene (PE), polypropylene (PP), polystyrene (PS), polystyrene foam (PSF), polyvinyl chloride (PVC), and the like. The plastic is a product of a petrochemical process, and from the perspectives of chemical structure and components thereof, the plastic is a high-molecular hydrocarbon. Therefore, by cleavage and degradation of hydrocarbon bonds of the high-molecular hydrocarbon, the plastic may be converted into ethylene or propene product, a raw material for the production of most plastic. Prior to maximized production of ethylene or propene with the waste plastic, the waste plastic is pretreated firstly, wherein the preheating includes at least one of shredding and iron removal. The shredding is performed by a shredding device 101. The waste plastic, used as the raw material, is transferred to the shredding device 101, and different shredders or crushers or a combination of them are needed depending on properties of different plastics, such that waste plastic fragments featuring suitable size and uniform distribution are obtained. When the raw material is soft plastic such as films, packing bags and the like, such plastic is shredded by a shredder. And, when the raw material is hard plastic such as housings or shells of electrical appliances, such plastic is crushed by a crusher. The iron removal comprises magnetically removing the iron-containing impurities by using a pipeline iron remover 102 so as to reduce impacts caused by the iron-containing impurities to the subsequent degradation of the waste plastic. It may be understood that mixed waste plastic from city, when used as the raw material, the mixed waste plastic from city contains fewer impurities, or has been subjected to the iron removal. In this case, the iron removal step may be skipped. The waste plastic subjected to shredding and/or iron removal may be directly transferred via a transfer mechanism to a melting vessel 1 for hot melting.

Figure 6:
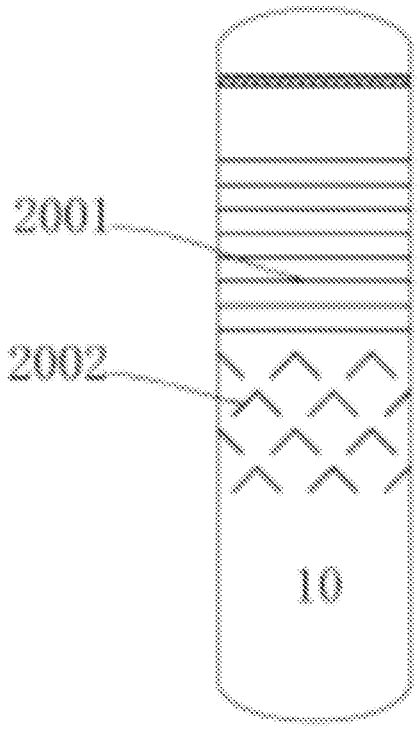
FIG. 6 illustrates a schematic structural view of a two-stage prewashing column in FIG. 1.

Secondly, the waste plastic transferred to the melting vessel 1 is melted into a liquefied substance (plastic oil) using superheated steam, which then collects at the bottom of the melting vessel 1. The waste plastic is melted into the liquefied substance under a temperature of 200-300° C. and a pressure of 0.01-0.5 MPa. The plastic oil obtained by melting the waste plastic is transferred to the top of a two-stage prewashing column 2 via 1 #transfer pump 103. As illustrated in FIG. 6, the two-stage prewashing column 2 includes a section for preheating 2001 and a section for desuperheating 2002. The two-stage prewashing column 2 preheats the plastic oil using high-temperature oil and gas at the discharge port of a catalytic cracking reactor 4. The temperature of the high-temperature oil and gas is 450-550° C. After the plastic oil passes through the section for preheating 2001 and the section for desuperheating 2002, the temperature of the plastic oil progressively rises plate by plate, and reaches 250-320° C. when reaching a column reactor. A part of the preheated plastic oil is transferred via 2 #transfer pump 202 to a mixer 3, and well-mixed with the superheated steam and fed to the catalytic cracking reactor 4. In addition, a part of the preheated plastic oil is circulated to the melting vessel 1 via 1 #circulation pump 203 and mixed with a freshly fed material, in order to increase the temperature of the freshly fed material and reduce energy consumption of the melting vessel 1.

In at least one embodiment, a middle section of the melting vessel 1 is provided with a filtering element, and the tank body of the melting vessel 1 is further provided with an inert heating medium inlet, an inert heating medium outlet, a liquid inlet, and a solid outlet. The inert heating medium inlet is disposed at the bottom of the tank body of the melting vessel 1, and is configured to input the superheated steam. Meanwhile, the inert heating medium outlet is disposed at the top of the tank body of the melting vessel 1, and is configured to discharge the superheated steam out. The discharged steam and some of the low-molecular gaseous products are transferred to the mixer 3 and well mixed with the preheated plastic oil. The fresh waste plastic is fed from a material feeding port to the filtering element, and melted by the superheated steam and converted into plastic oil. The plastic oil collects at the bottom of the melting vessel 1, and is discharged via the liquid outlet. The discharged plastic oil is preheated, and part of the plastic oil is returned, via a reflux port, to the filtering element, and mixed with the freshly fed material. Non-liquefied non-plastic waste remains in the upper space of the filtering element, and may be transferred outside via the solid outlet.

The plastic oil mixed in the mixer 3 is fed to the catalytic cracking reactor 4, and in the presence of a catalyst, the plastic oil is converted into high-temperature oil and gas, and waste residue. The catalytic cracking reactor 4 operates under conditions of: a reaction temperature of 300-600° C., a reaction pressure of 0.05-0.5 MPa, a catalyst-oil weight ratio of 6-12, and a space velocity of 0.1-30 $h^{-1}$; the catalyst in the catalytic cracking reactor 4 includes a molecular sieve catalyst, wherein the molecular sieve catalyst is one of molecular sieves of ZSM5, ZSM35, BETA, and USY or a modification thereof, and the catalytic cracking reactor 4 is one selected from a fixed fluidized bed or a circulating fluidized bed or a combination thereof. The waste residue remains in the catalytic cracking reactor 4, and the waste residue is discharged out of the catalytic cracking reactor 4 by superheated steam stripping.

Light distillate oil and heavy distillate oil, a gaseous product, and the like are obtained after the high-temperature oil and gas discharged from the catalytic cracking reactor 4 are cooled and purified by the two-stage prewashing column 2. The temperature at the top of the two-stage prewashing column 2 is 100-200° C., and the pressure at the top of the two-stage prewashing column 2 is 0.05-0.30 MPa; and the temperature in the column reactor is 250-320° C. In the section for desuperheating 2002, the high-temperature oil and gas are cooled from a superheated state to a saturated state, and meanwhile dusts carried by the oil and gas are washed out, and the heavy distillate oil is obtained in the column reactor. The pretreated mixed waste plastic from city, used as the raw material, is separately catalytically cracked. And, less heavy distillate oil is obtained in the column reactor, which may be even ignored. The high-temperature oil and gas are mainly oil and gas at the top of the column reactor. The cooled and purified oil and gas at the top of the column reactor are fed into a three-phase separator 201, the light distillate oil is discharged from the bottom of a tank, a non-condensable gaseous product is discharged from the top of the tank, and a small amount of sewage remains in the tank. The light distillate oil is transferred to a downstream oligomerization reactor 21, and the non-condensable gaseous product is transferred to a downstream steam cracking device 16.

Figure 2:
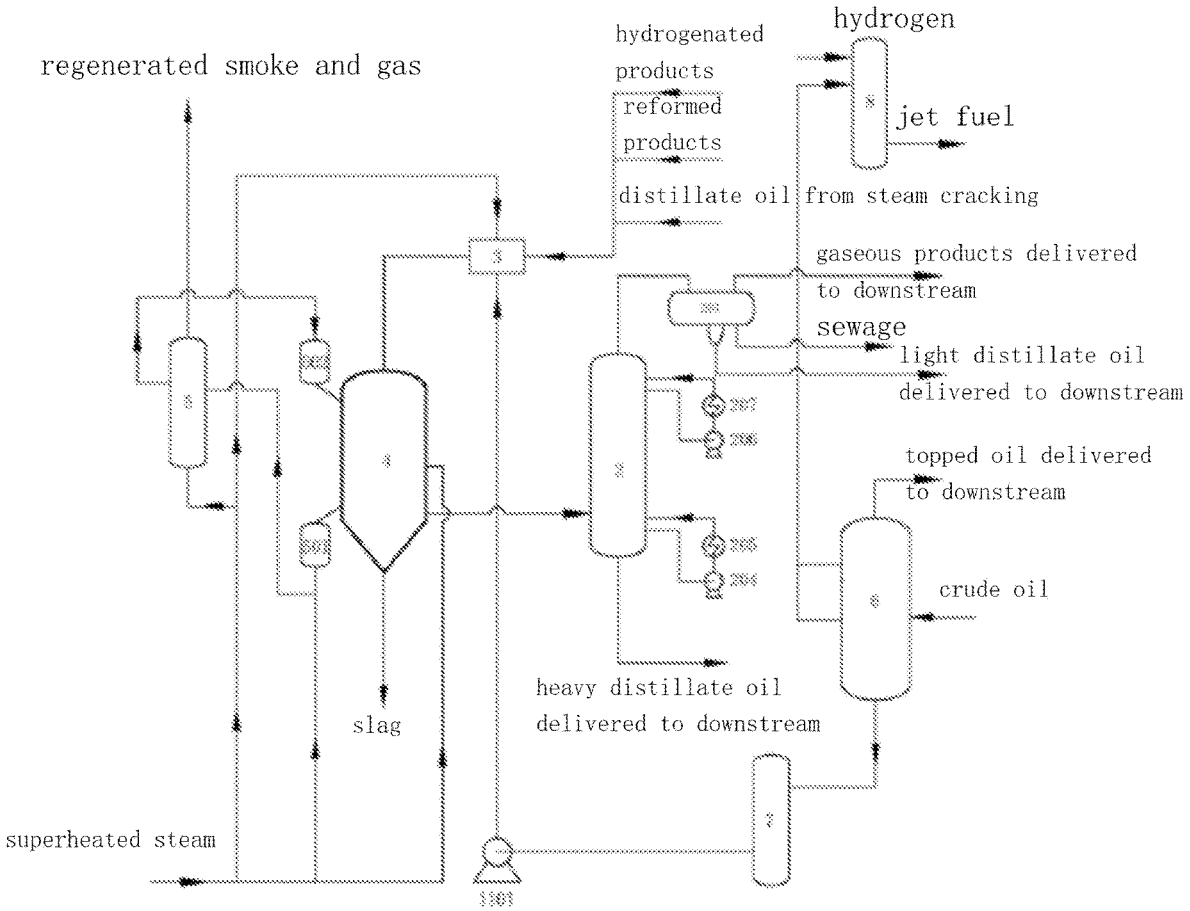
FIG. 2 illustrates a process flowchart of preheating and catalytic cracking for crude oil as a raw material.

Now referring to FIG. 2, in at least one embodiment of the method for maximizing production of ethylene or propene, crude oil is used as a raw material in the maximized production of ethylene or propene. Prior to maximized production of ethylene or propene with the crude oil, the crude oil is firstly pretreated. In the case that the raw material is crude oil, the pretreating includes at least one of electric desalination, atmospheric fractionating, and butane deasphalting, wherein after the crude oil is atmospherically fractionated in an atmospheric column 6, topped oil at the top of the column enters the downstream steam cracking device 16 to yield abundant ethylene, a first fraction of atmospheric distillation and a second fraction of atmospheric distillation extracted in side streams are treated by fixed bed hydrocracking in 1 #hydrogenation reactor 8 to obtain a jet fuel, and a remaining bottom fraction of atmospheric distillation is fed into the catalytic cracking reactor 4. Prior to being fed to the catalytic cracking reactor 4, the bottom fraction of atmospheric distillation is subjected to the butane deasphalting in a butane deasphalting column 7 and is modified, so as to remove impurities including heavy metal, asphalt, and colloid from the crude oil. The butane deasphalting is carried out under a temperature of 250-350° C. and a pressure of 0.5-1.2 MPa The modified bottom fraction of atmospheric distillation is transferred to the mixer 3 via 4 #transfer pump 1101, and well-mixed with other materials and fed into the catalytic cracking reactor 4, and in the presence of a catalyst, the plastic oil is converted into high-temperature oil and gas, and the waste residue. The catalytic cracking reactor 4 operates under conditions of: a reaction temperature of 300-600° C., a reaction pressure of 0.05-0.5 MPa, a catalyst-oil weight ratio of 6-12, and a space velocity of 0.1-30 $h^{-1}$; the catalyst in the catalytic cracking reactor 4 includes a molecular sieve catalyst, wherein the molecular sieve catalyst is one of molecular sieves of ZSM5, ZSM35, BETA, and USY or a modification thereof; and the catalytic cracking reactor 4 is one selected from a fixed fluidized bed or a circulating fluidized bed or a combination thereof. The waste residue remains in the catalytic cracking reactor 4, and the waste residue is discharged out of the catalytic cracking reactor 4 by superheated steam stripping.

Light distillate oil and heavy distillate oil, a gaseous product, and the like are obtained after the high-temperature oil and gas are transferred to and separated in the two-stage prewashing column 2. External circulation cooling devices are respectively disposed at the bottom and the top of the two-stage prewashing column 2. The external circulation cooling device at the bottom of the column is formed of 2 #circulation pump 204 and 1 #cooler 205, and the external circulation cooling device at the top of the column is formed of 3 #circulation pump 206 and 2 #cooler 207. The temperature at the top of the two-stage prewashing column 2 is 100-200° C., and the pressure at the top of the two-stage prewashing column 2 is 0.05-0.30 MPa; and the temperature in the column reactor is 250-320° C. After passing through the two-stage prewashing column 2, the high-temperature oil and gas are cooled from the superheated state to the saturated state. Heavy distillate oil is obtained from the column reactor, and oil and gas components are obtained from the top of the column reactor. The oil and gas at the top of the column reactor are fed into a three-phase separator 201, the light distillate oil is discharged from the bottom of a tank, a non-condensable gaseous product is discharged from the top of the tank, and a small amount of sewage remains in the tank. The light distillate oil is transferred to a downstream oligomerization reactor 21, and the non-condensable gaseous product is transferred to a downstream steam cracking device 16.

In at least one embodiment of the method for maximizing production of ethylene or propene, a mixture of mixed waste plastic from city and crude oil is used as raw materials. The components in the above mixture are pretreated in accordance with the methods for pretreating the materials as described above, and then the mixture is well-mixed in the mixture 3 and fed into the catalytic cracking reactor 4 for selective catalytic cracking, such that high-temperature oil and gas are obtained. In the case that the waste plastic accounts for a large proportion of the mixture, the temperature of the pretreated mixture when being fed is low. In this case, the high-temperature oil and gas may be used as a heat source, and in the two-stage prewashing column 2, the mixture is in direct contact with the high-temperature oil and gas such that the mixture is preheated. In this case, the high-temperature oil and gas are cooled from a superheated state to a saturated state. Heavy distillate oil is obtained in the column reactor of the two-stage prewashing column 2. And oil and gas components are obtained at the top of the two-stage prewashing column 2. The oil and gas at the top of the column reactor are fed into a three-phase separator 201, the light distillate oil is discharged from the bottom of a tank, a non-condensable gaseous product is discharged from the top of the tank, and a small amount of sewage remains in the tank. The light distillate oil is transferred to a downstream oligomerization reactor 21, and the non-condensable gaseous product is transferred to a downstream steam cracking device 16.

Figure 3:
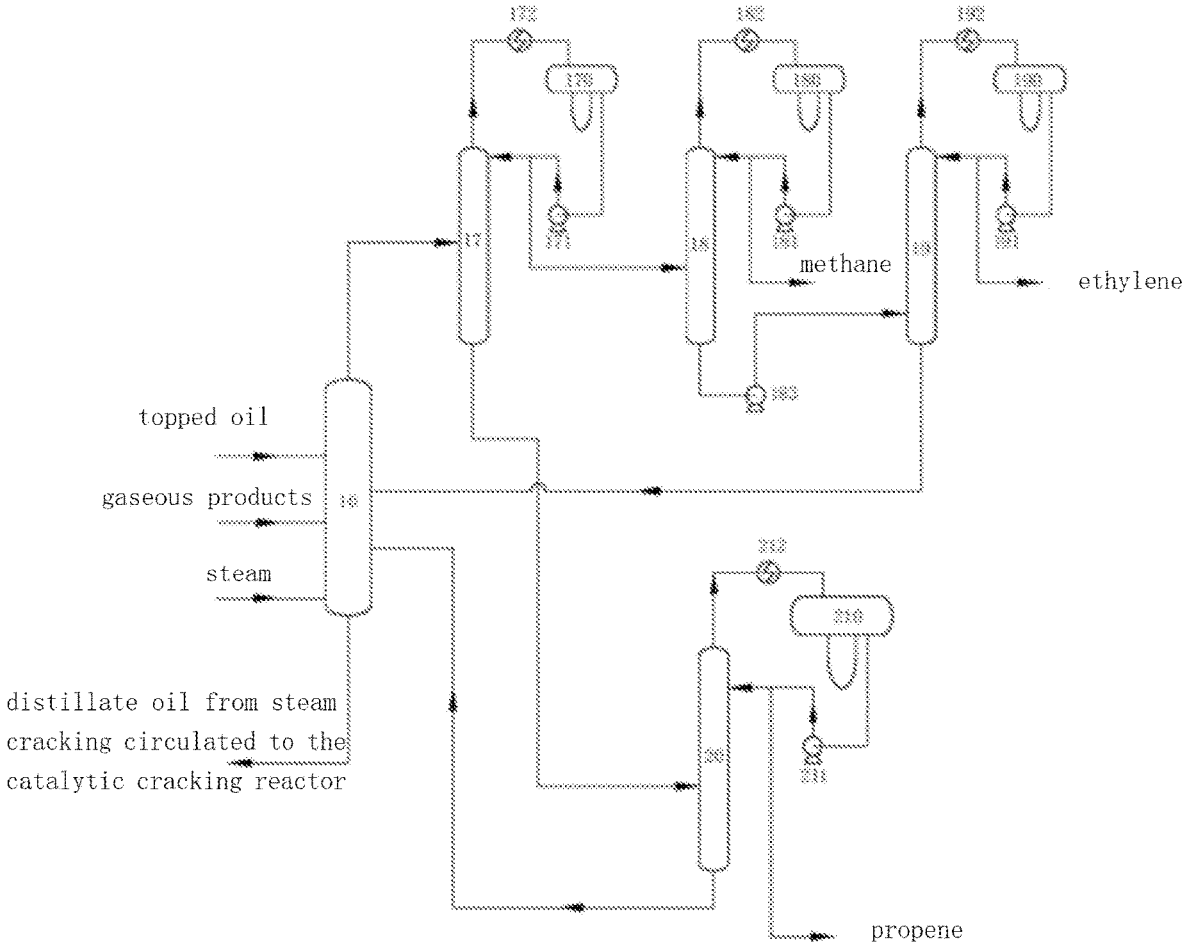
FIG. 3 illustrates a process flowchart of producing ethylene and/or propene by stream cracking alkanes in an intermediate reaction product.

Now referring to FIG. 3, the non-condensable gaseous product and/or the topped oil is transferred to the downstream steam cracking reactor 16 to steam-crack alkanes. The steam cracking is carried out under conditions of: a reaction temperature of 700-1000° C., a reaction pressure of 0.01-1.0 MPa, and residence time of 0.01-0.6 s. Methane, ethane, ethylene, propane, propene, and the like cracked products are obtained at the top of the steam cracking device 16, and steam-cracked distillate oil is obtained at the bottom of the steam cracking device 16. The steam-cracked distillate oil is recycled and returned to the catalytic cracking reactor 4 for selective catalytic cracking again.

The cracked products are firstly transferred to a $C_2$ removing column 17 to remove $C_2$. Products from the top of the $C_2$ removing column 17 are cooled in 1 #overhead cooler 172, and then fed into 1 #two-phase separator 170 for cooling separation. After separation, part of products are returned to the top of the $C_2$ removing column via 1 #reflux pump 171, and part of the products are extracted and transferred to a demethanizer column 18. Coarse propene distillate at the bottom of the $C_2$ removing column is transferred to a propene column 20 for separating propene. Products from the top of the demethanizer column 18 are cooled in 2 #overhead cooler 182, and then fed into 2 #two-phase separator 180 for cooling separation; and after separation, part of products are returned to the top of the demethanizer column 18 via 2 #reflux pump 181, and part of the products are extracted to obtain methane gas. Coarse ethylene distillate at the bottom of the demethanizer column is transferred, via 3 #transfer pump 183, to an ethylene column 19 for separating ethylene. Products from the ethylene column 19 are cooled in 3 #overhead cooler 192, and then fed into 3 #two-phase separator 190 for cooling separation; and after separation, part of the products are returned to the top of the ethylene column 19 via 3 #reflux pump 191, and part of the products are extracted to obtain ethylene gas. Products from the bottom of the ethylene column 19 are ethane, and the ethane is transferred to the steam cracking device 16 for steam cracking to obtain ethylene. Products from the propene column 20 are cooled in 4 #overhead cooler 212, and then fed into 4 #two-phase separator 210 for cooling separation; and after separation, part of the products are returned to the top of the ethylene column 20 via 4 #reflux pump 211, and part of the products are extracted to obtain propene gas. Products from the bottom of the propene column 20 are propane, and the propane is transferred to the steam cracking device 16 for steam cracking to obtain ethylene.

Figure 4:
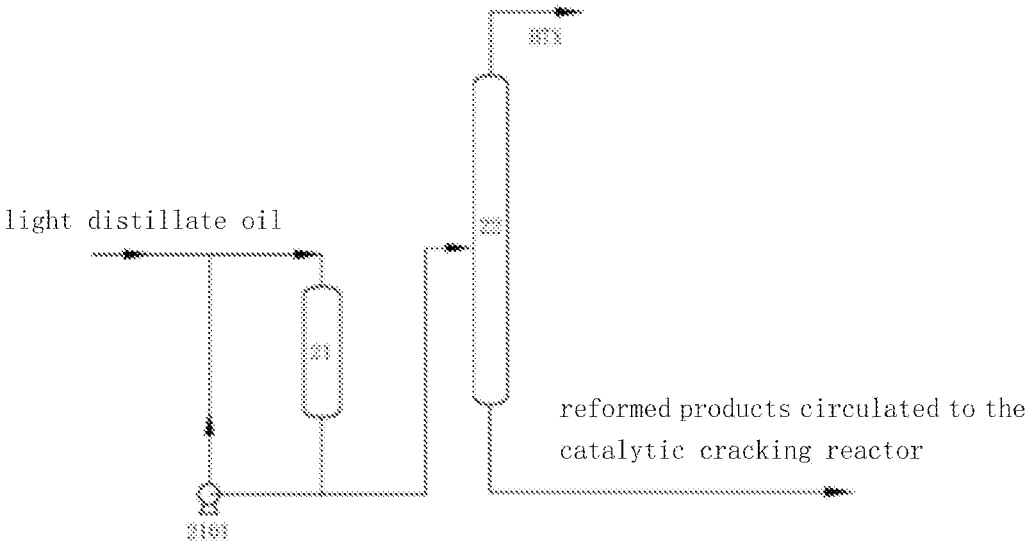
FIG. 4 illustrates a process flowchart of reforming alkenes for light distillate oil.

Now referring to FIG. 4, the light distillate oil is reformed in the oligomerization reactor 21, the alkene components are mainly C4-C9 alkenes, and the recombination refers to a process that the alkenes are oligomerized. The recombination is carried out under conditions of: a reaction temperature of 40-200° C., a reaction pressure of 0.5-5.0 MPa, and a space velocity of 0.1-6 $h^{-1}$. Products from the recombination are returned, via 5 #circulation pump 2101, to an inlet of the oligomerization reactor 21. Parts of the reformed products are separated in a distillation column 22, a by-product benzene-toluene-xylene (BTX) is obtained at the top of the distillation column, and the reformed products at the bottom of the distillation column are recycled and returned to the catalytic cracking reactor 4.

Figure 5:
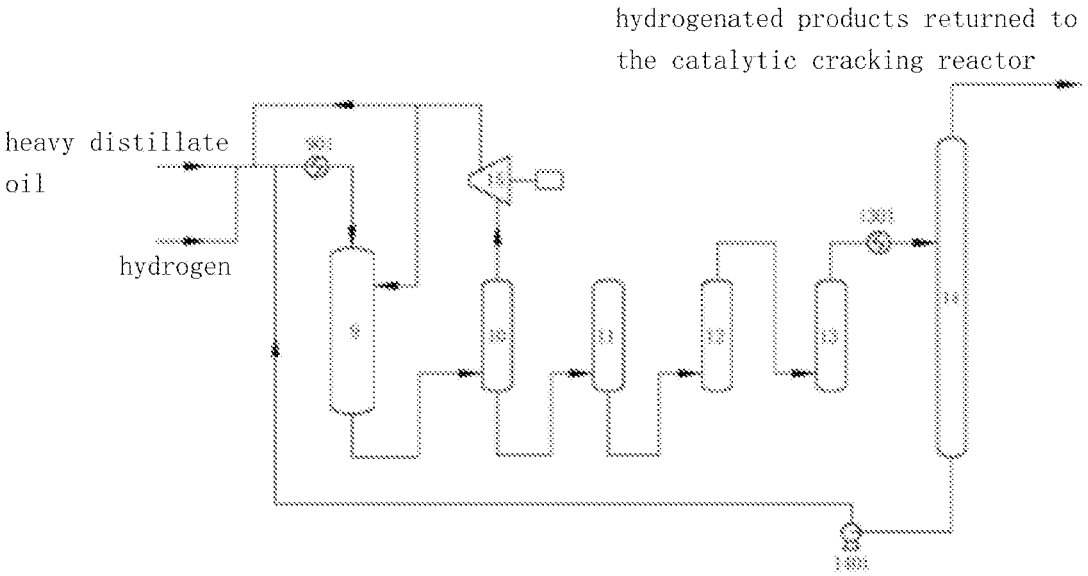
FIG. 5 illustrates a process flowchart of hydrogenating heavy distillate oil.

Now referring to FIG. 5, the heavy distillate oil is preheated in 1 #preheater 901 and then transferred to 2 #hydrogenation reactor 9 for hydrogenation reaction. The hydrogenated product is cooled and then fed into a high-pressure separator 10. Unreacted hydrogen is found at the top of the high-pressure separator 10. After the unreacted hydrogen is compressed by a compressor 15, part of the hydrogen returns to 2 #hydrogenation reactor 9, and part of the hydrogen returns and is mixed with the fed heavy distillate oil. Products at the bottom of the high-pressure separator 10 are sequentially washed by a low-pressure separator 11, a alkaline tower 12, and a water scrubber 13, and heated by 2 #preheater 1301 and then fed into a hydrogenated product distillation column 14 for distillation. Products at the bottom of the column are recycled and returned, via 4 #circulation pump 1401 to 2 #hydrogenation reactor 9, and products at the top of the column are recycled and returned to the catalytic cracking reactor 4.

The 2 #hydrogenation reactor 9 operates under conditions of: a reaction temperature of 300-550° C., a reaction pressure of 10.0-30.0 MPa, and a space velocity of 0.1-3 $h^{-1}$.

The high-pressure separator 10 and the low-pressure separator 11 operate under a pressure of 0.1-20.0 MPa.

The alkaline tower 12 and the water scrubber 13 operate under a pressure of 0.1-0.5 MPa.

The hydrogenated product distillation column 14 operates under conditions of: a pressure of 0.1-0.2 MPa, and a temperature of 100-200° C.

In at least one embodiment, the superheated steam has a temperature of 450-550° C. and a pressure of 0.2-0.5 MPa. The superheated steam is replaceable by another superheated inert medium, for example, nitrogen.

The steam-cracked distillate oil, the reformed products, and the hydrogenated products are recycled and returned to the catalytic cracking reactor 4 for selective catalytic cracking again, and a mass ratio of a total amount of the recycled products to an amount of a fresh raw material is 10-60:100.

In at least one embodiment, the catalytic cracking reaction is characterized in that the products of the reaction are selectable. When the reaction is intended for maximizing production of the ethylene, propane and butane are firstly obtained as the main products of the catalytic cracking reaction, the total yield of the propane and butane is about over 60 m % of the raw materials. And, the propane and butane are then fed into the steam cracking device to produce the ethylene. That is, production of the ethylene is maximized. When the reaction is intended for maximizing production of the propene, the main product of the catalytic cracking reaction is propene, the yield of the propene is about over 40 m % of the raw materials. In this case, the yield of the propane and butane by steam cracking is about 10-20 m % of the raw material. Apparently, the catalytic cracking process is responsible for converting plastic oil (or referred to as a liquefied substance of waste plastic), a bottom fraction of atmospheric distillation and the like into the propene and BTX, or the propane and BTX. The steam cracking process is responsible for converting topped oil, and alkanes including propane, butane and the like produced by catalytic cracking into the ethylene. In addition, cracked gasoline and the like liquid-phase products produced by the steam cracking are returned into the catalytic cracking reactor 4 for redistillation.

By the above steps, the raw materials are finally converted into the products including methane, the ethane, ethylene, propene, BTX, and the like, wherein the total yield of the ethylene and propene is 45-75 m % of the raw materials, the yield of the arene BTX is 15-30 m % of the raw materials, and the majority of the remainder is methane.

Still referring to FIG. 1 and FIG. 2, after catalytic cracking reaction takes place for a period of time, the catalyst in the catalytic cracking reactor 4 is deactivated due to carbon deposition, and the catalyst is regenerated. This process mainly includes the following steps. The catalyst is unloaded from the catalytic cracking reactor 4 through a catalyst unloading line and collects in a buffer tank 501. Then, steam is introduced into the buffer tank 501 for stripping, and oil gas carried on the catalyst is removed. The catalyst is then transferred to a regenerator 5. A superheated medium and a suitable amount of air are introduced into the regenerator 5 to convert the carbon deposited on the catalyst into $CO_2$ and $H_2O$, and activity of the catalyst is gradually recovered. The regenerated catalyst is transferred to a catalyst dosing tank 502 above the catalytic cracking reactor 4. The pressure in the catalyst dosing tank 502 is increased after the regenerated catalyst is transferred, such that the pressure is higher than an internal pressure of 0.1-0.2 MPa in the catalytic cracking reactor 4. The catalyst enters the catalytic cracking reactor 4 again under the action of a pressure difference and gravity.

The regenerated catalyst can be reused. The catalyst can be recycled for many times, and the regenerated heat source is replaceable by a superheated medium, such as steam, nitrogen, and the like. A suitable amount of air is introduced into the superheated medium during regeneration. In the case that the catalytic cracking reactor 4 is replaced by a fluidized bed, the catalyst is continuously circulated between the reactor and the regenerator 5, and air is directly introduced into the regenerator 5.

In at least one specific embodiment, as shown in Table 1 and Table 2, the process operating conditions and products distribution for maximizing production of propene or ethylene for different raw material compositions are listed.

TABLE 1

| | Example 1 | Example 2 | Example 3 |
|---|---|---|---|
| Composition of raw materials | Mixed waste plastic from city | Crude oil | 20 m % of mixed waste plastic from city and 80 m % of crude oil |
| | Operating conditions of devices | | |
| Melting vessel 1 | Temperature: 180° C. Pressure: 0.13 MPa | Temperature: 150° C. Pressure: 0.15 MPa | Temperature: 180° C. Pressure: 0.13 MPa |
| Atmospheric distillation column 6 | Temperature at the top of the column: 116° C. Pressure: 0.16 MPa Temperature in the column reactor: 310° C. | Temperature at the top of the column: 110° C. Pressure: 0.12 MPa Temperature in the column reactor: 308° C. | Temperature at the top of the column: 116° C. Pressure: 0.16 MPa Temperature in the column reactor: 310° C. |
| Two-stage prewashing column 2 | Temperature at the top of the column: 150° C. Pressure: 0.1 MPa Temperature in the column reactor: 300° C. | Temperature at the top of the column: 200° C. Pressure: 0.13 MPa Temperature in the column reactor: 320° C. | Temperature at the top of the column: 150° C. Pressure: 0.1 MPa Temperature in the column reactor: 300° C. |
| Catalytic cracking reactor 4 | Reaction temperature: 450° C. Reaction pressure: 0.15 MPa; space velocity: 25 $h^{-1}$ Catalyst: Y-type molecular sieve + ZSM35 molecular sieve (85:15) Catalyst-oil weight ratio: 6 | Reaction temperature: 520° C. Reaction pressure: 0.10 MPa Space velocity: 20 $h^{-1}$ Catalyst: Y-type molecular sieve + ZSM5 molecular sieve (85:15) Catalyst-oil weight ratio: 8 | Reaction temperature: 450° C. Reaction pressure: 0.15 MPa; space velocity: 25 $h^{-1}$ Catalyst: Y-type molecular sieve + ZSM35 molecular sieve (85:15) Catalyst-oil weight ratio: 6 |
| 2# Hydrogenation reactor 9 | Reaction temperature: 365° C. Reaction pressure: 18.0 MPa; space velocity: 1 $h^{-1}$ | Reaction temperature: 353° C. Reaction pressure: 21.0 MPa; space velocity: 0.8 $h^{-1}$ | Reaction temperature: 360° C. Reaction pressure: 18.0 MPa; space velocity: 1 $h^{-1}$ |
| Steam cracking device 16 | Reaction temperature: 880° C. Reaction pressure: 0.50 MPa; residence time: 0.2 s | Reaction temperature: 950° C. Reaction pressure: 0.30 MPa; residence time: 0.1 s | Reaction temperature: 1000° C. Reaction pressure: 0.45 MPa; residence time: 0.05 s |
| Oligomerization reactor 21 | Reaction temperature: 100° C. Reaction pressure: 1.50 MPa; space velocity: 1 $h^{-1}$ | Reaction temperature: 80° C. Reaction pressure: 4.00 MPa; space velocity: 1 $h^{-1}$ | Reaction temperature: 100° C. Reaction pressure: 1.50 MPa; space velocity: 1 $h^{-1}$ |
| Reformed product distillation column 22 | Temperature at the top of the column: 50° C. Pressure: 0.6 MPa Temperature in the column reactor: 200° C. | Temperature at the top of the column: 55° C. Pressure: 0.7 MPa Temperature in the column reactor: 208° C. | Temperature at the top of the column: 50° C. Pressure: 0.6 MPa Temperature in the column reactor: 200° C. |
| | Product yield: | | |
| Methane | 5.0% | 7.2% | 5.0% |
| Ethylene | 45.3% | 30.1% | 35.3% |
| Propene | 27.7% | 34.4% | 37.7% |

TABLE 1-continued

| | Example 1 | Example 2 | Example 3 |
|---|---|---|---|
| BTX | 15.0% | 20.0% | 15.0% |
| Coke | 6.6% | 7.7% | 6.6% |
| Others | 0.4% | 0.6% | 0.4% |

TABLE 2

| | Example 4 | Example 5 | Example 6 |
|---|---|---|---|
| Composition of raw materials | 30 m % of mixed waste plastic from city and 70 m % of crude oil | 40 m % of mixed waste plastic from city and 60 m % of crude oil | 50 m % of mixed waste plastic from city and 50 m % of crude oil |
| Operating conditions of devices | | | |
| Melting vessel 1 | Temperature: 180° C. Pressure: 0.13 MPa | Temperature: 150° C. Pressure: 0.15 MPa | Temperature: 200° C. Pressure: 0.1 MPa |
| Atmospheric distillation column 6 | Temperature at the top of the column: 116° C. Pressure: 0.16 MPa Temperature in the column reactor: 310° C. | Temperature at the top of the column: 110° C. Pressure: 0.12 MPa Temperature in the column reactor: 308° C. | Temperature at the top of the column: 120° C. Pressure: 0.18 MPa Temperature in the column reactor: 320° C. |
| Two-stage prewashing column 2 | Temperature at the top of the column: 150° C. Pressure: 0.1 MPa Temperature in the column reactor: 300° C. | Temperature at the top of the column: 200° C. Pressure: 0.13 MPa Temperature in the column reactor: 320° C. | Temperature at the top of the column: 100° C. Pressure: 0.05 MPa Temperature in the column reactor: 250° C. |
| Catalytic cracking reactor 4 | Reaction temperature: 450° C. Reaction pressure: 0.15 MPa; space velocity: 25 $h^{-1}$ Catalyst: Y-type molecular sieve + ZSM5 molecular sieve (85:15) Catalyst-oil weight ratio: 6 | Reaction temperature: 520° C. Reaction pressure: 0.10 MPa Space velocity: 20 $h^{-1}$ Catalyst: Y-type molecular sieve + ZSM5 molecular sieve (85:15) Catalyst-oil weight ratio: 8 | Reaction temperature: 480° C. Reaction pressure: 0.05 MPa Space velocity: 10 $h^{-1}$ Catalyst: Y-type molecular sieve + ZSM5 molecular sieve (85:15) Catalyst-oil weight ratio: 10 |
| 2# Hydrogenation reactor 9 | Reaction temperature: 360° C. Reaction pressure: 18.0 MPa; space velocity: 1 $h^{-1}$ | Reaction temperature: 355° C. Reaction pressure: 21.0 MPa; space velocity: 0.5 $h^{-1}$ | Reaction temperature: 365° C. Reaction pressure: 20.0 MPa; space velocity: 0.6 $h^{-1}$ |
| Steam cracking device 16 | Reaction temperature: 820° C. Reaction pressure: 0.40 MPa; residence time: 0.2 s | Reaction temperature: 850° C. Reaction pressure: 0.30 MPa; residence time: 0.1 s | Reaction temperature: 900° C. Reaction pressure: 0.45 MPa; residence time: 0.05 s |
| Oligomerization reactor 21 | Reaction temperature: 100° C. Reaction pressure: 1.50 MPa; space velocity: 1 $h^{-1}$ | Reaction temperature: 80° C. Reaction pressure: 4.00 MPa; space velocity: 1 $h^{-1}$ | Reaction temperature: 110° C. Reaction pressure: 2.00 MPa; space velocity: 0.8 $h^{-1}$ |
| Reformed product distillation column 22 | Temperature at the top of the column: 50° C. Pressure: 0.6 MPa Temperature in the column reactor: 200° C. | Temperature at the top of the column: 55° C. Pressure: 0.7 MPa Temperature in the column reactor: 208° C. | Temperature at the top of the column: 50° C. Pressure: 0.65 MPa Temperature in the column reactor: 210° C. |
| Product yield: | | | |
| Methane | 5.0% | 7.2% | 6.3% |
| Ethylene | 25.3% | 40.1% | 16.9% |
| Propene | 47.7% | 24.4% | 38.1% |
| BTX | 15.0% | 20.0% | 30.0% |
| Coke | 6.6% | 7.7% | 8.2% |
| Others | 0.4% | 0.6% | 0.5% |

Therefore, in the method or maximizing production of ethylene or propene according to the present disclosure, the yield of the chemical products is obviously higher than that in a combination of conventional oil refining processes. In the method of the present disclosure, the totally yield of the ethylene and the propene is 45-75 m % of the raw materials, and the ethylene and the propene can be recycled as the raw materials for preparing plastic in industry. In addition, arene BTX is a by-product in the whole process, wherein the yield of the arene is 15-30 m % of the raw materials. In addition, the yields of by-products, methane and coke, are low.

The method of the present disclosure for maximizing production of ethylene or propene can not only take crude oil as a raw material for catalytic cracking reaction, but also maximize production of high-value raw materials including ethylene, propene and BTX. Furthermore, the mixed waste plastic from city can be used as the raw materials, and after the waste plastic is correspondingly pretreated, high-value raw materials including ethylene, propene and BTX can be maximally produced. As such, the economic benefit and the social benefit are remarkable.

The basic principle, main features and advantages of the present disclosure are described and illustrated above. A person skilled in the art would understand that the present disclosure is not limited to the above embodiments. The above embodiments and description in the specification are only intended to elaborate the principle of the present disclosure. Various variations and improvements may also be made to the present disclosure without departing from the spirit and scope of the present disclosure. These variations and improvements all fall within the projection scope defined by the appended claims. The scope of the present disclosure is subject to the appended claims and equivalents thereof.

What is claimed is:

1. A method for maximizing production of ethylene or propylene, characterized by comprising:

S1, pretreating a raw material, mixing the pretreated raw material with superheated steam in a mixer, and feeding the well-mixed raw material and superheated steam into a catalytic cracking reactor, wherein the raw material is converted into waste residue and high-temperature oil and gas in the presence of a catalyst;

obtaining light distillate oil, heavy distillate oil, a gaseous product, by cooling and purifying the high-temperature oil and gas using a two-stage prewashing column; wherein the two-stage prewashing column comprises a section for preheating and a section for desuperheating;

S2, hydrogenating the heavy distillate oil in step S1, reforming alkene components in the light distillate oil and separating benzene-toluene-xylene (BTX) components in the light distillate oil as one of products; and feeding alkane components in the light distillate oil to a steam cracking device;

S3, recycling the products formed by hydrogenating and the products formed by reforming, and the steam-cracked distillate oil obtained in step S2 to the catalytic cracking reactor in step S1, and once more carrying out a selective catalytic cracking reaction in the catalytic cracking reactor, wherein a mass ratio of a total amount of the recycled products to an amount of a fresh raw material is 10-60:100; and S4, feeding the gaseous product in step S1 to the steam cracking device, and collectively separating methane, ethane, ethylene, propane, propylene, wherein ethylene and propylene are used as the products; and returning the ethane, the propane, other alkanes to the steam cracking device;

wherein by the above steps, the raw material is finally converted into the products comprising methane, the ethane, ethylene, propylene, BTX, wherein the total yield of ethylene and propylene is 45-75 m % of the raw materials, the yield of the arene BTX is 15-30 m % of the raw materials, and the majority of the remainder is methane.

2. The method for maximizing production of ethylene or propylene according to claim 1, wherein in the case that the raw material comprises mixed waste plastic from city, the pretreating comprises: at least shredding or removing iron from the mixed waste plastic from city; feeding the waste plastic to a melting vessel, and melting the waste plastic in the melting vessel with superheated steam to a liquefied substance and collecting the liquefied substance at the bottom of the melting vessel, wherein the waste plastic is melted into the liquefied substance under a temperature of 150-250° C. and a pressure of 0.01-0.5 MPa; and finally feeding the liquefied substance of the waste plastic to the two-stage prewashing column, and preheating with the high-temperature oil and gas as a heat source, mixing the preheated liquefied substance of the waste plastic as the raw material with the superheated steam to obtain a mixture, and feeding the mixture to the catalytic cracking reactor.

3. The method for maximizing production of ethylene or propylene according to claim 2, wherein a temperature of the liquefied substance of the waste plastic, through the section for preheating and the section for desuperheating, progressively rises plate by plate and reaches 250-320° C. when reaching a column reactor, and the preheated liquefied substance of the waste plastic enters the catalytic cracking reactor through a mixer for catalytic cracking, and part of the liquefied substance is cyclically returned to the melting vessel.

4. The method for maximizing production of ethylene or propylene according to claim 1, wherein in the case that the raw material comprises crude oil, the pretreating comprises at least one of: electric desalination, atmospheric fractionating, and butane deasphalting, wherein after the crude oil is atmospherically fractionated, topped oil enters the steam cracking device to yield ethylene, a first fraction of atmospheric distillation and a second fraction of atmospheric distillation are treated by fixed bed hydrocracking to obtain a jet fuel, and a remaining bottom fraction of atmospheric distillation is totally fed into the catalytic cracking reactor.

5. The method for maximizing production of ethylene or propylene according to claim 4, wherein prior to being fed to the catalytic cracking reactor, the bottom fraction of atmospheric distillation is subjected to the butane deasphalting and is modified, to remove impurities comprising heavy metal, asphalt, colloid, from the crude oil; and the butane deasphalting is carried out under a temperature of 100-200° C. and a pressure of 2.0-6.0 MPa.

6. The method for maximizing production of ethylene or propene according to claim 1, wherein a temperature at the top of the two-stage prewashing column is 100-200° C. and a pressure at the top of the two-stage prewashing column is 0.05-0.30 MPa; a temperature at a bottom of the two-stage prewashing column is 250-320° C., and in the section for desuperheating, the high-temperature oil and gas is cooled from a superheated state to a saturated state and dust carried by the high-temperature oil and gas is washed away, and the heavy distillate oil is obtained in the bottom of the two-stage prewashing column, the high-temperature oil and gas at a top of the two-stage prewashing column is cooled and enters a three-phase separator, the light distillate oil is discharged from a bottom of the three-phase separator, non-condensable gas are discharged from a top of the three-phase separator.

7. The method for maximizing production of ethylene or propene according to claim 1, wherein in step S1, the catalytic cracking reactor operates under conditions of: a reaction temperature of 300-600° C., a reaction pressure of 0.05-0.5 MPa, a catalyst-oil weight ratio of 6-12, and a space velocity of 0.1-30 $h^{-1}$; the catalyst in the catalytic cracking reactor comprises a molecular sieve catalyst, wherein the molecular sieve catalyst is one of molecular sieves of ZSM5, ZSM35, BETA, USY, or a modification thereof; and the catalytic cracking reactor is one selected from a fixed fluidized bed or a circulating fluidized bed or a combination thereof.

8. The method for maximizing production of ethylene or propene according to claim 1, wherein in step S2, the reformation is carried out in an oligomerization reactor under conditions of a reaction temperature of 40-200° C., a reaction pressure of 0.5-6.0 MPa, and a space velocity of 0.1-6 $h^{-1}$.

* * * * *